US005627018A

United States Patent [19]

Nakayama

[11] Patent Number: 5,627,018

[45] Date of Patent: May 6, 1997

[54] SILVER HALIDE PHOTOGRAPHIC EMULSION

[75] Inventor: Tomoyuki Nakayama, Hino, Japan

[73] Assignee: Konica Corporation, Tokyo, Japan

[21] Appl. No.: 482,149

[22] Filed: Jun. 8, 1995

[30] Foreign Application Priority Data

Jun. 17, 1994 [JP] Japan ..... 6-135987

[51] Int. Cl.[6] ..... G03C 1/09; G03C 1/035; G03C 1/015

[52] U.S. Cl. ..... 430/567; 430/569; 430/603; 430/604; 430/605

[58] Field of Search ..... 430/567, 569, 430/603, 604, 605

[56] References Cited

U.S. PATENT DOCUMENTS 5,298,383 3/1994 Mihayashi et al. ..... 430/567

5,460,936 10/1995 Kondo et al. ..... 430/569

FOREIGN PATENT DOCUMENTS 0371338 6/1990 European Pat. Off. ..... G03C 1/10

0501306A1 9/1992 European Pat. Off. ..... G03C 7/36

2130389 5/1984 United Kingdom ..... G03C 1/06

*Primary Examiner*—Mark F. Huff

*Attorney, Agent, or Firm*—Frishauf, Holtz, Goodman, Langer & Chick, P.C.

[57] ABSTRACT

A silver halide photographic emulsion is disclosed, comprising silver halide grains containing a heavy metal ion and reduction sensitization nucleus within the grains, the grains having an overall average iodide content ($I_2$) of 2 to 30 mol % and satisfying the following requirement, $$I_1<I_2$$

where $I_1$ represents an iodide content of an outermost surface layer of the grains.

17 Claims, No Drawings

SILVER HALIDE PHOTOGRAPHIC EMULSION

FIELD OF THE INVENTION

The present invention relates to a silver halide grain emulsion and particularly to noble silver halide grains improved in photographic characteristics.

BACKGROUND OF THE INVENTION

With the recent widespread of such a photographic apparatus as a camera, photo-taking opportunities have also increased with the use of a silver halide photographic light sensitive material. According thereto, there have been increasing demands for further improvements in sensitivity and image quality. One of the dominant factors to the high sensitivity and high image-quality of a silver halide photographic light sensitive material is concerned with silver halide grains. Research and development of silver halide grains have also progressed so far in the field of the art, with the purpose of making the sensitivity and image quality thereof to be higher. However, there have been a limit to satisfy both of high sensitivity and high image-quality, because the sensitivity thereof tends to be lowered when the size of silver halide grains is made smaller so as to improve the image quality, as has usally been attempted in the art.

To achieve further improvement in sensitivity and image quality, techniques for enhancement of a ratio of sensitivity/grain size per a grain have been studied so far; for example, the use of tabular grains was disclosed in JP-A 58-111935/1983, 58-111936/1983, 58-111938/1983, 58-113927/1983 and 59-99433/1984 (the term "JP-A" means an "unexpected published Japanese patent application"). Comparing to octaheral, tetradecahedral or hexahedral crystal grains, socalled, regular crystal silver halide grains, these tabular grains have larger surface area per volume so that more sensitizing dyes are adsorbed to the silver halide surface to increase advantageously the sensitivity.

There were described a technique for provide a core having high silver iodide content within silver halide tabular grains in JP-A 63-92942/1988 and the use of silver halide tabular grains having a ratio of grain thickness to the longest distance between twin planes of 5 or more in JP-A 63-163451/1988, each showing the effects thereof on the sensitivity and graininess.

There were disclosed the use of silver halide tabular grains having substantially a layered structure in the direction parallel to two opposed major faces and silver halide tabular grains having substantially a layer structure divided by a plane parallel to two opposed major faces and comprising the outermost layer having a silver iodide content, by not less than 1 mol %, more than the average overall silver iodide content in JP-A 63-92942/1988 and JP-A 1-279237/1989, respectively. In addition thereto, JP-A 1-183644/1989 discloses silver iodohalide tabular grains having a uniform iodide distribution.

Furthermore, as a technique for incresing sensitivity, there are disclosed the use of silver halide tabular grains having dislocation lines localized in a specified position within the grain or concentrated in the vicinity of the corner in JP-A 63-220238/1988 and 3-175440/1991, respectively, and those having a definite core/shell structure or three-layered core/shell structure in JP 3-18695/1991 and 3-31245/1991 (the term "JP" means examined published Japanese patent).

It is, however, difficult to accomplish both high-sensitivity and high image-quality by these prior arts and insufficient to satisfy the demands in modern photographic light sensitive material; therefore development of superior technique has been desired.

In one aspect, there has been known a technique of metal-doping, whereby carrier-control is attempted. The metal-doping is a technique of occluding a polyvalent metal compound within silver halide grains to improve photographic characteristics; there are cited doping of an iridium compound as disclosed in JP-A 62-7042/1987 and an iron compound doping as disclosed in JP-A 1-121844/1989.

Further, there has been known reduction sensitization as a technique for attaining high-sensitization of silver halide. With respect to the reduction sensitization, an optimally reduction-sensitized nucleus has been considered to attribute the sensitization when exposed to light, through the following reaction, as disclosed in Journal Photographic Science Vol. 25, pages 19–27 (1977); Photographic Science and Engineering, Vol. 23, pages 113–117 (1979); Photographishe Korrespondenz Vol. 1, page 20 (1957) and Photographic Science and Engineering, Vol. 19, pages 49–55 (1975).

$$AgX+h\nu \rightarrow e^- + h^+ \quad (1)$$

$$Ag_2+h^+ \rightarrow Ag^+ + Ag \quad (2)$$

$$Ag \rightarrow Ag^+ + e^- \quad (3)$$

where $h^+$ and $e^-$ represent a free positive hole and free electron produced on exposure, hν represents a photon and $Ag_2$ represents a reduction sensitization nucleus.

According to Photographic Science and Engineering, Vol. 16 pages 35–42 (1971) and ibid Vol. 23 pages 113–117 (1979), it is contemplated that the reduction sensitization nucleus is inherently capable of trapping not only positive hole but also an electron and at the present time, therefore, the mechanism thereof cannot be sufficiently explained only based on the above theory.

The role of the reduction sensitization in the spectral sensitizing range of spectarally-sensitized silver halide grains in the form of being used in a silver halide photographic light sensitive material, which is different from that in a sensitivity range inherent to silver halide has been difficult to be expected because of complexity of a latent image-forming process.

In a spectrally sensitized silver halide emulsion, generally speaking, a dye absorbs light so that the initial step in the latent image-forming process, which is different from that in a inherent sensitivity range has been contemplated to be represented by the following (4), in place of (1) above-described.

$$\mathrm{Dye}+h\nu \rightarrow \mathrm{Dye}^+ + e^- \quad (4)$$

Probability as to whether a dye positive hole ($Dye^+$) and electron ($e^-$) are transferred to the silver halide grains depends largely on property of the dye. Regarding the dye positive hole, it has been considered, in general that a sensitization efficiency is better in the case when the dye positive hole is not transferred to the inside of the silver halide grains, as discussed in relation with an oxidation potential of the dye in Photographic Science and Engineering Vol. 24 pages 138–143 (1980).

It was suggested in Collective Abstracts of International Congress of Photographic Science pages 159–162 (1978) and Photographic Science and Engineering Vol. 17 pages 235–244 (1973) that a sensitizing dye of which positive hole is liable to be trapped on the surface of the silver halide grains is to bleach a fogging nucleus or reduction sensitization nucleus. In a conventional surface latent image-forming emulsion, therefore, the surface latent image is presumed to be bleached, leading to desensitization.

As mentioned so far, it has not been known as yet which the reduction sensitization is applied the surface of silver halide grains or the inside thereof or what kind of a dye is to be combined therewith to display the effect.

As a method of applying the reduction sensitization practically to a silver halide emulsion, there have been known some examples such as application of the reduction sensitization to the surface of the grains or to the grain in a process of preparation thereof, and grain growth from redution-sensitized seed grains.

A method in which reduction sensitization is applied to the grain surface, when combined with other sensitization (gold or sulfur sensitization), results in a remarkable increase in fog and is not suited for practical use. On the other hand, a method in which the reduction sensitization applied to the grains in a process of the preparation thereof was reported not to display such disadvantage as above-mentioned. This method, as described, for example, in JP-A 48-87825/1973 or 57-179835/1982, however, is concerned with an improvement in inherent sensitivity, not in spectral sensitivity.

There was described in JP-A 58-127920/1983 an improvement in spectral sensitivity when silver halide grains are internally reduction-sensitized, however, the effect thereof was limited to a spectral sensitizing dye having an oxidation potential of 0.5 V or more.

Today, in the market, there is an increasing tendency to regard stability in quality so important that latent image stability has been more in demand than ever. As a result of surveys of consumers' application of photographic film, the fact revealed that photographic films have been used under severe conditions after exposure, for example, a film is kept in the camera without being developed, or the camera or film was left near a window or in a car during the hot summer season. It is recognized to be important in actual practice that after being exposed, a latent image must be stably preserved even under such severe conditions. However, in the prior arts, there have not been viable means to meet such requirements.

SUMMARY OF THE INVENTION

The present invention has been accomplished in view of the foregoing circumstances, and the object thereof is to provide a silver halide photographic light sensitive material excellent in sensitivity, reciprocity law failure characteristics and latent image stability.

The above object is accomplished by a silver halide emulsion comprising silver halide grains containing a polyvalent metal ion and reduction sensitization nucleus in an internal portion of the grain; said silver halide grains having an average iodide content ($I_2$) of 2 to 30 mol %, the uppermost layer of the grains having an average iodide content of $I_1$ (mol %) and satisfying the following requirement, $I_1<I_2$.

DETAILED DESCRIPTION OF THE INVENTION

Silver halide grains of the invention may be regular crystal grains such as cube, octahedron and tetradecahedron or irregular crystal grains such as spherical or tabular grains. These grains may have {100} face and {111} face in any ratio. The grains may be comprised of ones having composite form thereof or a mixture thereof. There may be used silver halide twinned crystal grains having two opposed twin planes parallel with each other, among which tabular grain are preferable. The term, "twinned crystal" herein means a silver halide crystal having one or more twin planes therewithin. Classification of twinned crystal form is described in detail in Klein and Moisar, Photographishe Korrespondenz Vol. 99, page 99 and ibid Vol. 100, page 57.

Silver halide tabular grains of the invention account preferably for 60% or more and more preferably, 70% or more of the projected ares of the total grains. A ratio of diameter to thickness thereof (alternatively, aspect ratio) is 1.3 to 5.0, preferably 1.5 to 4.5, more preferably 2.0 to 4.0.

A silver halide emulsion containing silver halide grains of the invention has an average grain size of 0.1 to 5.0, preferably 0.2 to 3.0 more preferably 0.3 to 2.0μ, wherein the average grain size is defined as a grain diameter of $r_i$ when a product of a frequency $n_i$ of grains having a diameter $r_i$ and $r_i^3$ ($n_i \times r_i^3$) is a maximum value, in which 1000 or more grains are measured at random. Regarding a diameter of the tabular grain, the grain diameter is defined as a diameter of a circle equivalent to the projected area of the grain projected in the direction perpendicular to the major face thereof. In the case of grains in another form, the diameter thereof is defined as a diameter of a circle having an area equivalent to the projected area thereof.

A silver halide emulsion of the invention may be a polydispersed emulsion having a broad grain-size distribution or a monodispersed emulsion having narrow grain-size distribution, and a monodispersed emulsion having a distribution width of 20% or less is preferable. The distribution width is defined as follows.

Distribution width (%)=(Standard deviation/average diameter)×100.

The composition of silver halide may be silver iodobromide, silver bromide, silver iodochloride, silver iodochlorobromide or silver chloride and silver iodobromide or silver iodochlorobromide is preferable. The average iodide content of silver halide grains is less than 30 mol %, preferably 3 to 20 mol %. When $I_1$ and $I_2$ are respectively an average overall iodide content of the grains and an average iodide content of the outermost surface layer of the grains, it is required to be $I_1<I_2$, preferably $I_1<0.8\times I_2$ and more preferably $I_1<0.6\times I_2$.

Silver halide grains of the invention have preferably plural silver halide phases different in halide composition.

In the invention, the average iodide content of silver halide grains can be determined by EPMA method (Electron Probe Micro Analyser method). Thus, there is prepared a sample in which silver halide grains are dispersed so as not to be in contact with each other. The sample is then subjected to electron-beam exposure while being cooled down to −100° C. or less with liquid nitrogen. The iodide content of the grains can be determined from strengths of characteristic X-rays of silver and iodide radiated from silver halide grains, wherein 50 or more grains are subjected to measurement to calculate an average value thereof.

An average iodide content of the outermost surface layer within the grain of the invention is not less than 0 mol % and not more than 15.0 mol % (preferably, not more than 8.0 mol % and more preferably, not more than 6.0 mol %).

In silver halide grains of the invention, an internal portion of the grain containing a polyvalent metal ion and a reduction sensitization nucleus means an inner portion within a diameter of a sphere corresponding to 97% of the ultimate grain volume of the grains, provided that the outermost surface layer of the grains is not included therein. Preferably, it is an inner portion within a diameter corresponding to 90% of the ultimate grain volume except for the outermost surface layer; more preferably, an inner portion within a diameter corresponding to 70% of the ultimate grain volume, except for the outermost surface layer; and most preferably, an inner portion within a diameter corresponding to 50% of the ultimate grain volume, except for the outermost surface. As employed therein, the term, "the outermost surface layer" means a silver halide phase in a region which X-rays penetrate and reach from the surface of the silver halide grain, when an iodide content of the surface is measured in an XPS method (X-ray Photoelectron Spectroscopy). Such a region as above-described, which is within the outermost layer including the surface corresponds to a region of 50 Å in depth from the surface. The halide composition of the outermost surface layer can be determined by the XPS method. The XPS method has been known as a method for determining an iodide content of the surface of silver halide grains, as disclosed in JP-A 2-24188/1990. When measured at an ordinary temperature, however, it was found that the exact iodide content of the outermost surface layer was unable to be determined because of the destruction of a sample by X-ray exposure. According to the further studies made by the inventor, the exact iodide content thereof was successfully determined by cooling down to such a temperature that the sample was scarecely destroyed. From the result thereof, it was proved that, in core/shell type grains different in composition between the surface and internal portions or grains containing a high (or low) iodide phase localized in a surface portion, a measured value at an ordinary temperature is largely different from the true value due to the destruction of silver halide by X-ray exposure and the diffusion of halide (specifically, iodide) ions.

Concretely, an aqueous 0.05 wt % proteinase solution is added to an emulsion, with stirring for 30 min. at 45° C., to decompose gelatin. After sedimenting emulsion grains by centrifugation, the supernatant solution is removed. Next, distilled water is added thereto to disperse the grains in water, followed by centrifuging and removing the supernant. Resulting emulsion grains are further dispersed in water and thinly coated on a mirror-polished silicon wafer to prepare a sample. To prevent the destruction upon exposure to X-ray, thus prepared sample is cooled down to a temperature of −110° to −120° C. under vacuum of not more than $10^{-8}$ torr in a XPS-measuring chamber and exposed to MgKα-ray, as X-ray for probe, at a source voltage of 15 KV and a source cerrent of 40 mA so as to be measured with respect to electrons of $Ag^{3d5/2}$, $Br^{3d}$ and $I^{3d3/2}$. Integral intensities of each peaks measured are corrected by a sensitivity factor and from the ratio of the intensities, the halide composition can be determined.

One feature of silver halide grains of the invention is that reduction sensitization is applied during the formation of an internal portion of the grain. The word, "during the formation of an internal portion of the grain" means a process of forming a silver halide phase ranging from the start of the growth of silver halide phase correponding to the internal portion of the grain by supplying silver ions, halide ions and/or silver halide grains to the completion thereof. In other words, in the process of forming a silver halide grain emulsion of the invention, the emulsion is reduction-sensitized until 97% of the total amount of silver to be supplied has been added. Preferably, the emulsion is reduction-sensitized until 90% (more preferably, 70%) of the total amount of silver has been added.

The present invention is characterized in that the reduction sensitization is applied concentratedly to the internal portion of the grain; and a silver halide phase which has been reduction-sensitized is contemplated to be present, in the internal portion of the grain, in a layer-form. The reduction-sensitized phase localized in the internal portion of the grain is presumed to contribute indirectly to the formation of latent image on the surface of silver halide grains and preservation thereof; presumably, the reduction-sensitized phase itself does not play a role in forming directly a latent image. In other words, silver halide grains of the invention are presumed to be surface latent image-forming type (not internal latent image-forming type).

In the invention, reduction sensitization is carried out by adding a reducing agent into a protective colloid solution in which silver halide grains are grown, or ripening or growing the grains at pAg of not more than 7.0 or at pH of not less than 7.0 during the process of grain growth.

As a reducing agent, is usable thiourea dioxide, ascorbic acid and a derivative thereof, a stannous salt, a borane compound, a hydrazine compound, formamidine sulfinic acid, silan compound, an amine and polyamines, or a sulfite salt; preferably, thiourea dioxide, ascorbic acid and a derivative thereof or a stannous salt. An adding amount thereof is from $10^{-8}$ to $10^{-2}$, preferably, $10^{-7}$ to $10^{-3}$ mol per mol of silver halide.

In the invention, when the reduction sensitization is carried out at a low pAg of 7.0 or less, it is preferable that the ripening or growth of silver halide grains be carried out after adding a silver salt into a protective colloid solution to make the pAg an appropriate value. As a silver salt, is preferable a water-soluble silver salt, more preferable silver nitrate. A pAg value in the ripening is preferably 1.8 to 5.0, wherein the pAg is a common logarithm of reciprocal of silver ion concentration.

In the invention, when the reduction sensitization is carried out at a high pH of 7.0 or more, it is preferable that the ripening or growth of silver halide grains be carried out after adding an alkaline compound into a protective colloid solution to make the pH an appropriate value. As the alkaline compound, are cited sodium hydroxide, potassium hydroxide and ammonia.

The reduction sensitization of the invention is most effectively performed when the pH of a protective colloid solution is made 7.0 or more, during the grain growth, preferably 7.5 to 11.0, more preferably 8.0 to 10.0

A reducing agent, silver salt for reduction-ripening or alkaline compound may be added instantaneously or over a period of time. In the latter case, it may be added at a constant rate or accelerated rate. It may be added separately in a necessary amount. It may be allowed to be present prior to the addition of water-soluble silver salt and/or water-soluble halide salt into a reaction vessel. It may be added mixedly with a halide salt solution or separately from a water-soluble silver salt and a water-soluble halide salt.

After completing the formation of the internal portion of the grain, it is preferable to remove immediately reducing atmosphere for preventing silver halide grains from being further fogged. In the case when reduction sensitization is carried out at a high pH, it is preferable to lower the pH slowly in a process of grain growth after the reduction sensitization so as to reach a pH of 5.0 to 6.5 at the time when the grain growth has been completed and prior to desalting. It is more preferable to lower the pH promptly to 4.5 to 6.5 (preferably, 5.0 to 6.0) by adding an acid immediately after the completion of the reduction sensitization.

As an acid is preferable acetic acid or nitric acid. In the case when the reduction sensitization is carried out at a low pAg, it is preferable to return the pAg to a range of grain growth after completion of ripening and continue further to cause to grow the grains. In the case when the reduction sensitization is carried out by adding a reducing agent, it is preferable to add the reducing agent immediately before starting the growth of the internal portion of the grain and deactivate the reducing agent immediately after completion of ripening. To deactivate the reducing agent, is preferably used hydrogen peroxide and an addition salt thereof such as $H_2O_2$, $NABO_2$, $H_2O_2$-$3H_2O$, $2NaCO_3$-$3H_2O$, $Na_4P_2O_7$ or $2Na_2SO_4$-$H_2O_2$, a peroxyacid salt such as $K_2S_2O_3$, $K_2C_2O_3$, $K_4P_2O_3$ or $K_2[Ti(O_2)C_2O_4]$–$3H_2O$, peracetic acid, ozone or a thiosulfonic acid compound. These oxidizing agents may be used for other purpose than deactivation of the reducing agent.

An addition of the oxidizing agent, depending on the kind of the reducing agent, the condition of reduction sensitization and the addition time or addition condition of the oxidizing agent, is preferably in an amount of $10^{-3}$ to $10^{-5}$ mol per mol of reducing agent. The oxidizing agent may be added at any time during the course of preparing silver halide grains. It may be added prior to the addition of the reducing agent. As to an adding method thereof, there may be applied a well-known method of adding an additive to a silver halide emulsion.

After addition of the oxidizing agent, a reducing material may be further added to neutralize an oxidizing agent in excess. As the reducing material, are cited sulfinic acids, di- or tri-hydroxybenzenes chromans, hydrazines, hydrazide, p-phenylenediamines, aldehydes, aminophenols, enediots, oxime, reducing sugars, phenidones, sulfites and ascorbic acids. An addition amount thereof is preferably $10^{-3}$ to $10^{3}$ mol per mol of oxidizing agent.

A method known in the art is applicable to the preparation of silver halide grains of the invention.

In the case when seed grains are used in preparing silver halide grains of the invention, the seed grains may have a regular crystal form such as cube, octahedron or tetradecahedron, or an irregular crystal form such as a spherical or tabular form. The grains may comprise {100} face and {111} face in any ratio. Twinned crystal seed grains having two parallel opposed twin planes or monodispersed spherical seed grains are preferably used.

As to preparation of silver halide grains of the invention, is preferable acidic or neutral precipitation in which grain growth is performed without the use of an ammonium compound, and more preferable is a neutral precipitation. The word, "ammonium compound" indicates generally a water-soluble compound capable of releasing an ammonium ion, including an aqueous ammonia solution, ammonia adduct, ammonium salt, ammonia complex salt and ammonium oxide. Instead of the ammonium compound, a silver halide solvent such as a thioether or thiourea may be usable.

A polyvalent metal ion occluded in silver halide grains of the invention can be optimally selected according to the object and use thereof. Examples thereof are ions of metals such as Mg, Al, Ca, Sc, Ti, V, Cr, Mn, Fe, Co, Ni, Cu, Zn, Ga, ge, Sr, Y, Zr, Nb, Mo, Tc, Ru, Pd, Cd, Sn, Sb, Ba, La, Hf, Ta, Ce, Eu, W, Re, Os, Ir, Pt, Au, Tl, Pb, Bi and In. These ions may be used singly or in combination thereof. A metal compound can be selected from simple salts and complex salts. In the case of the complex salt, it may be a monocyclic complex or polycyclic complex; it is preferably selected from six-coordinated, five-coordinated, four-coordinated and two-coordinated complexes. Among them are more preferable octahedral six-coordinated complex and tabular four-coordinated complex. As a ligand constituting the complex is cited $CN^-$, CO, $NO_2^-$, 1,10-phenantrolin, 2,2-bipyridine, $SO_3^{2-}$, ethylenediamine, $NH_3$, pyridine, $H_2O$, $NCS^-$, $NCO^-$, $NO^{3-}$, $SO_4^{2-}$, $OH^-$, $CO_3^{2-}$, $N^{3-}$, $S^{2-}$, $F^-$, $Cl^-$, $Br^-$ or $I^-$.

In the invention, preferably, $Pb^{2+}$, $In^+$, $In^{3+}$ $Ir^{3+}$, $Ir^{4+}$ or $Fe^{2+}$ is occluded within the grain.

The metal compound may be added in the form of a solution or solid. It may be added to a reaction mother liquor prior to or during the growth of silver halide grains. To control the metal ion distribution within the grain, there can be used a method as disclosed in Japanese Patent Application No. 5-122806/1993. An addition amount thereof is $1\times10^{-10}$ to $1\times10^{-2}$, preferably $1\times10^{-9}$ to $5\times10^{-4}$.

In the invention, a dispersing medium is a material capable of consituting a protective colloid, such as gelatin. As a gelatin, is cited an acid-processed elatin or lime-processed gelatin. As other dispersing medium, are cited a gelatin derivative; graft-polymer of gelatin with a polymer; protein such as alubmin, casein; cellulose derivative such as hydroxyethylcellulose, carboxymethylcellulose or cellulose sulfuric acid ester; a sugar derivative such as sodium alginate or a starch derivative; a synthetic or semi-synthetic hydrophilic polymer compound such as polyvinyl alcohol, pertial acetat thereof, poly-N-vinylpyrrolidone, polyacrylic acid, polyacrylamide, polymethaacrylic acid, polynimylimidAzile or polyvinytbutyral. In the invention, it is the most preferable to use a gelatin.

In the invention, an aqueous protective colloid solution in which silver halide grain growth is performed indicates an aqueous solution in which grain growth is performed and a protective colloid is formed by a gelatin or another material capable of forming a protective colloid. Preferably, it is an aqueous solution containing gelatin in a protective colloid form.

In a silver halide emulsion of the invention, unnecessary water-soluble salts may be removed therefrom after completion of the grain growth. As to desalting, are applicable techniques as described in Research Disclosure (hereinafter, denoted as RD) No. 17643, section II.

In the preparation of silver halide emulsion grains of the invention, to make an average iodide content of the outermost surface layer of the grains ($I_1$) less than an average overall iodide cotent of the grains ($I_2$), it is effective to supply silver halide fine grains after desalting and prior to subjecting to chemical sensitization or spectral sensitization during the course of the preparation of the silver halide grains to form the outermost surface layer or at least a part of an outermost shell-layer including the outermost surface layer.

In the invention, the course of preparation of a silver halide grain emulsion comprises nucleation, growth (in the case when seed grains are used, it starts from the growth of seed grains), desalting, dispersion of desalted emulsion grains, chemical sensitization process and spectral sensitzation process. Therefore, it does not include a process of preparing a coating solution and subsequent processes.

In the case when using silver halide fine grains in the invention, the fine grains may be prepared previously or concurrently with the preparation of silver halide grains of the invention. In the latter case, as disclosed in JP-A 1-183417/1989 and 2-44335/1990, the fine grains are prepared in a mixer vessel provided outside a reactor vessel in which a silver halide emulsion is prepared, or as disclosed in JP-A 4-184327/1992, fine grains prepared in the mixer vessel is transferred to a adjustment vessel, in which the fine grain are adjusted in accordance with growing enviroments in the reactor vessel, and thereafter supplied to the reactor vessel. The fine grains are prepared preferably under acidic or neutral condition (pH≦7).

Silver halide fine grains is prepared by mixing an aqueous silver salt solution and an aqueous alkali halide solution under the optimal control of a super-saturation factor. The super-saturation factors are referred to JP-A 63-92942/1988 and 63-311244/1988. To prevent the fine grains from fogging, pAg during the course of forming the fine grains is maintained preferably to be not less than 3.0; more preferably, not less than 5.0; and further more preferably, not less than 8.0. The temperature may be 50° C. or lower, preferably, 40° C. or lower and more preferably, 35° C. or lower. As a protective colloid, is usable gelatin.

When silver halide fine grains are formed at a low temperature, Ostwald ripening is restrained after the formation thereof but gelatin is liable to be coagulated, so that it is preferable to use a low molecular weight gelatin as disclosed in JP-A 2-166442/1990, a synthetic polymer capable of being a protective colloid for silver halide grains or a natural polymer compound other than gelatin. The concentration of the protective colloid is preferably 1 wt. % or more, more preferably 2 wt. % or more, and further more preferably 3 to 10 wt. %.

Silver halide fine grains which is supplied into a grain-forming protective colloid solution is readily dissolved therein to form silver and halide ions, leading to uniform grain growth. The fine grain size is preferably 0.1 μm or less, more preferably 0.05 μm or less. The fine grains may be supplied at an accelerated flow rate using a funnel or pump. The fine grains may be divisionaly added. After adding the grains, there may be optionally carried out ripening.

In the preparation of a silver halide emulsion of the invention, an appropriate condition may be sellected with reference to JP-A 61-6643/1986, 61-14630/1986, 61-112142/1986, 62-157024/1987, 62-18556/1987, 63-92042/1988, 63-15168/1988, 63-163451/1988, 63-220238/1988 and 63-311244/1988.

The silver halide emulsion of the invention can be used in a silver halide photographic material, preferably in a silver halide color photographic material.

In constituting the color photographic material using a silver halide emulsion of the invention, a silver halide emulsion which is subjected to physical ripening, chemical sensitization or spectral sensitization can be used. Additives used in these processes are described in Research Disclosure Nos. 17643, 18716 and 308119 (hereinafter, abbreviated as RD17643, RD18716 and RD308119). Relevant portions thereof are as follows.

| Item | RD308119 | RD17643 | RD18716 |
|---|---|---|---|
| Chemical sensitizer | 996 III-A | 23 | 648 |
| Spectral sensitizer | 996 IV-A, A–D, H–J | 23–24 | 648–9 |
| Supersensitizer | 996 IV-a-E, J | 23–24 | 648–9 |
| Fog inhibitor | 998 VI | 24–25 | 649 |
| Stabilizer | 998 VI | 24–25 | 649 |

Photographic additives usable in constituting a color photographic material by using a silver halide emulsion of the invention are described in the following Research Disclosures.

| Item | RD308119 | RD17643 | RD18716 |
|---|---|---|---|
| Anti-color stain agent | 1002 VII-I | 25 | 650 |
| Dye image stabilizer | 1001 VII-J | 25 | |
| Britening agent | 998 V | 24 | |
| UV absorber | 1003 VIII-C XIIIC | 25–26 | |
| Optical absorber | 1003 VIII | 25–26 | |
| Light-scattering agent | 1003 VIII | | |
| Filter dye | 1003 VIII | 25–26 | |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, Coating-aid | 1005 XI | 26–27 | 650 |
| Matting agent | 1007XVI | | |
| Developer (contained in photographic material) | 1011 XXB | | |

Various couplers can be used for constituting a color photograpnic material by using a silver halide emulsion of the invention and examples theeof are described in the following Research Disclosure.

| Item | RD308119 | RD17643 |
|---|---|---|
| Yellow coupler | 1001 VII-D | VII C–G |
| Magenta coupler | 1001 VII-D | VII C–G |
| Cyan coupler | 1001 VII-D | VII C–G |
| Colored coupler | 1002 VII-G | VII G |
| DIR coupler | 1001 VII-F | VII F |
| BAR coupler | 1002 VII-F | |
| PUG-releasing coupler | 1001 VII-F | |
| Alkali-soluble coupler | 1001 VII-E | |

Additives used for constituting a color photographic material by using a silver halide emulsion of the invention may be added by a dispersing method as described RD308119 XIV.

In the invention, there may be used supports as described in RD17643, page 28; RD18716, pages 647–8; and RD 308119 XVII.

A color photographic material of the invention may be provided with an auxiliary layer such as a filter layer or interlayer, as described in RD308119 VII-K.

A color photographic material of the invention can take any layer structure such as a normal layer structure, reversed layer structure or unit constitution, as described in RD308119 VII-K.

A silver halide emulsion of the invention is applicable to various color photographic light sensitive materials such as a color negative film for general purpose or movie, color reversal film for slide or TV, color paper, color positive film and color reversal paper.

A silver halide color photographic light sensitive material can be processed in a conventional manner, as described in RD17643 pages 28–29, RD 18716 page 615 and RD 308119 XIX.

EXAMPLES

Examples of the present invention will be explained in detail by citing examples but the invention are not limited thereto.

Example 1

Preparation of twinned crystal seed grain emulsion (T-1)

With reference to JP-A 5-34851/1993, an emulsion (T-1) containing seed grains having two parallel twin planes was prepared according to the following procedure.

| | |
|---|---|
| Solution A | |
| Ossein gelatin | 80.0 g |
| Potassium bromide | 47.4 g |
| 10% Methanol solution of $HO(CH_2CH_2O)_m$—$[CH(CH_3)CH_2O]_{19.8}(CH_2CH_2O)_nH$ (m ± n = 9.77) | 0.48 ml |
| Water to make | 8000.0 ml |
| Solution B | |
| Silver nitrate | 1200.0 g |
| Water to make | 1600.0 ml |
| Solution C | |
| Ossein gelatin | 32.2 g |
| Potassium bromide | 790.0 g |
| Potassium iodide | 70.34 g |
| Water to make | 1600.0 ml |
| Solution D | |
| Aqueous ammonia solution (28%) | 470.0 ml |

To solution A at 40° C., were added, with stirring by a stirrer as described in JP-A 62-160128/1987, Solutions B and C for 7.7 min. by a double jet technique to form nucleus grains, while being maintained at pBr of 1.60.

Thereafter, the temperature was lowered to 20° C. taking 35 min. Further, Solution D was added for 1 min., followed by ripening over a period of 5 min. The concentrations of KBr and ammonia were respectively 0.03 and 0.66 mol/l during the ripening.

After ripening, the pH was adjusted to 6.0 and the emulsion was desalted according to a conventional manner. Electron microscopic observation revealed that an average grain size was 0.225 μm and silver halide grains having two parallel twin planes accounted for 60% in number of the total grains.

Preparation of comparative emulsion (Em-1)

Comparative emulsion (Em-1) was prepared using the following five solutions.

| | |
|---|---|
| Solution A-1 | |
| Ossein gelatin | 66.5 g |
| Distilled water | 3227.0 ml |
| 10% Methanol solution of $HO(CH_2CH_2O)_m$—$[CH(CH_3)CH_2O]_{19.8}(CH_2CH_2O)_nH$ (m ± n = 9.77) | 2.50 ml |
| Seed grain emulsion (T-1) | 98.5 g |
| Distilled water | 3500 ml |
| Solution B-1 | |
| Aqueous 3.5 N silver nitrate solution | 4702.0 ml |
| Solution C-1 | |
| Potassium bromide | 2499.0 g |
| Distilled water to make | 6000 ml |

Solution D-1

Fine grain emulsion comprising silver iodide fine grains (Av.size, 0.05 μm) and gelatin (3%)

The fine grain emulsion was prepared as follows. To 5000 ml of a 6.0 wt. % gelatin solution containing 0.06 mol og possium iodide, were added an aqueous solution containing 7.06 mol of silver nitrate and aqueous solution containing 7.06 mol of potassium iodide for 10 min., while being maitained at 40° C. The finished weight of the resulting emulsion was 12.53 Kg.

Solution E-1

Aq. 1.75N potassium bromide solution, necesary amount

Solution A-1 was added to a reaction vessel and thereto were added Solutions B-1 through D-1 by a double jet addition according to Table 1 to cause to grow the seed grains to prepare core/shell type silver halide emulsion.

Adding rates (1) of Solutions B-1, C-1 and D-1 and adding rates (2) of Solutions B-1 and C-1 were acceleratedly changed in proportion to a critical growing rate not so as to produce fine grains and cause polydispersion.

The solution in the reaction vessel was maintained at a temperature of 75° C. and a pAg of 8.8. To control pAg, was added Solution E-1 optionally. Although the pH was not specifically controlled, the pH was kept within a range of 5.0 to 6.0. Adding amounts of silver and iodide versus adding time were shown in Table 1, provided that the adding amount of iodide indicates an iodide content of the total halide, expressed in mol %.

After completing grain growth, the resulting emulsion was subjected to desalting according to a method as disclosed in JP-A 5-72658/1993. After adding thereto 1.19 liter of 20 wt. % gelatin solution and dispersing at 50° C. for 30 min., the pH and pAg were respectively adjusted to 5.8 and 3.55 at a temperature of 40° C.

It was proved that resulting silver halide emulsion was comprised of monodispersed tabular silver halide grains having an average diameter of 1.34 μm (circle-equivalent diameter), average aspect ratio of 2.6 and a grain size distribution width of 18%.

TABLE 1

| Adding solutions | Adding time (min.) | Silver amount added (%) | Iodide content (mol %) |
|---|---|---|---|
| (1)B-1, C-1, D-1 | 0.00 | 0.0 | 10.0 |
| (1)B-1, C-1, D-1 | 30.99 | 3.0 | 10.0 |
| (1)B-1, C-1, D-1 | 52.47 | 6.0 | 10.0 |
| (1)B-1, C-1, D-1 | 76.48 | 10.0 | 10.0 |
| (1)B-1, C-1, D-1 | 76.48 | 10.0 | 30.0 |
| (1)B-1, C-1, D-1 | 117.30 | 18.0 | 30.0 |
| (1)B-1, C-1, D-1 | 150.13 | 25.0 | 30.0 |
| (1)B-1, C-1, D-1 | 150.13 | 25.0 | 10.0 |
| (1)B-1, C-1, D-1 | 176.09 | 31.0 | 10.0 |
| (2)B-1, C-1 | 176.09 | 31.0 | 0.0 |
| (2)B-1, C-1 | 209.51 | 50.0 | 0.0 |
| (2)B-1, C-1 | 221.07 | 64.0 | 0.0 |
| (2)B-1, C-1 | 230.68 | 80.0 | 0.0 |
| (2)B-1, C-1 | 239.00 | 100.0 | 0.0 |

Preparation of comparative emulsion (Em-2)

Comparative emulsion (Em-2) was prepared in the same manner as comparative emulsion (Em-1), provided that, at a time of 52.47 min. after starting the addition of Solutions B-through D-1 the, pH was adjusted to 8.0 with a 10% sodium hydroxide solution; after desalting and dispersing for 15 min. at a temperature 50° C. by adding thereto 1.19 liter of 20 wt. % gelatin solution, the pAg was adjusted to 1.5 with a 3.5N potassium bromide solution; and after adding Solution H-0 over sec. period and stirring further over 20 min. period, the pH and pBr were respectively adjusted to 5.80 and 3.55 at 40° C.

Solution H-0

Fine grain emulsion containing silver bromide grains (av. size, 0.04 μm) and 3 wt. % gelatin 0.212 mol.

Changes in the pH value in the reaction vesel were as follows.

| Time* | pH |
|---|---|
| 52.47 | 8.00 |
| 76.48 | 7.51 |
| 150.13 | 6.40 |
| 176.09 | 6.36 |
| 239.00 | 5.84 |

*Time after staring the addition of Solutions B-1 through D-1

Preparation of comparative emulsion (Em-3)

Comparative emulsion (Em-3) was prepared in the same manner as comparative emulsion (Em-1), provided that, after adding Solution A-1 to the reaction vessel and before adding thereto Solutions B-1 through D-1, the following Solution H-1 was added.

Solution H-1

Aqueous 0.1% (volume) $HNO_3$ solution containing $InCl_3 4H_2O$ of $2\times10^{-5}$ mol per mol of Ag of Em-1

Preparation of comparative emulsion (Em-4)

Comparative emulsion (Em-4) was prepared in the same manner as comparative emulsion (Em-3), provided that Solution H-2 was added in place of Solution H-1.

Solution H-2

Aqueous solution containing $PbNPO_3$ of $1\times10^{-5}$ mol per mol of silver of Em-4

Preparation of inventive emulsion (Em-5)

Inventive emulsion (Em-5) was prepared in the same manner as comparative emulsion (Em-2), provided that, after adding Solution A-1 to the reaction vessel and before adding Solutions B-1 through D-1 thereto, Solution H-1 was added.

Preparation of inventive emulsion (Em-6)

Inventive emulsion (Em-6) was prepared in the same manner as comparative emulsion (Em-2), provided that, after adding Solution A-1 to the reaction vessel and before adding Solutions B-1 through D-1 thereto, Solution H-2 was added.

Preparatio of comparative emulsion (Em-7)

Comparative emulsion (Em-7) was prepared in the same manner as comparative emulsion (Em-1), provided that at a time of 52.47 min. after starting the addition of Solutions B-1 through D-1, the following solution K-1 was added.

Solution K-1

Aqueous solution containing thiourea dioxide of $1\times10^{-6}$ per mol of Ag of Em-7

Preparation of inventive emulsion (Em-8)

Inventive emulsion (Em-8) was prepared in the same manner as comparative emulsion (Em-7), provided that, after adding Solution A-1 to the reaction vessel and before adding Solutions B-1 through D-1 thereto, Solution H-1 was added.

Characteristics of emulsions (Em-1) through (Em-8) were shown in Table 2.

TABLE 2

| Emulsion | Grain size (μm) | Aspect ratio | Distribution width (%) | Iodide content $I_1$ (mol %) | Iodide content $I_2$ (mol %) | Reduction sensitization | Metal ion |
|---|---|---|---|---|---|---|---|
| Em-1 (Comp.) | 1.34 | 2.6 | 18 | 5.0 | 6.1 | No | No |
| Em-2 (Comp.) | 1.35 | 2.4 | 16 | 3.7 | 6.0 | pH8.0 | No |
| Em-3 (Comp.) | 1.35 | 2.4 | 17 | 3.6 | 6.1 | No | $In^{3+}$ |
| Em-4 (Comp.) | 1.32 | 2.3 | 19 | 4.4 | 6.0 | No | $Pb^{2+}$ |
| Em-5 (Inv.) | 1.35 | 2.4 | 16 | 4.0 | 6.1 | pH8.0 | $In^{3+}$ |
| Em-6 (Inv.) | 1.31 | 2.3 | 19 | 4.4 | 6.0 | pH8.0 | $Pb^{2+}$ |
| Em-7 (Comp.) | 1.33 | 2.5 | 19 | 3.9 | 6.2 | Thiourea dioxide | No |
| Em-8 (Inv.) | 1.35 | 2.5 | 19 | 3.9 | 5.9 | Thiourea dioxide | $In^{3+}$ |

Emulsions (Em-1) through (Em-8) were optimally subjected to chemical sensitization. These emulsions were denoted as Emulsion A in the formula of the following photographic samples.

Multilayered color photographic light sensitive material samples 11 to 18 were prepared by providing, on a triacetylcellelose film support, layers comprising the following compositions in this order from the support.

The addition amount was denoted as g per $m^2$, unless specifically described. The amount of silver halide or colloidal silver is denoted as an amount converted to silver and that of a sensitizing dye is mol per mol of silver halide contained in the same layer as the dye.

| | |
|---|---|
| 1st Layer: Antihalation layer | |
| Black colloidal silver | 0.16 |
| UV absorber (UV-l) | 0.20 |
| High boiling solvent (Oil-1) | 0.16 |
| Gelatin | 1.23 |
| 2nd layer: Interlayer | |
| Compound (Sc-1) | 0.15 |
| High boiling solvent (Oil-2) | 0.17 |
| Gelatin | 1.27 |
| 3rd lyer: Low speed red-sensitive layer | |
| Silver iodobromide emulsion (Av. grain size: 0.38 μm, Av. iodide content: 8.0 mol %) | 0.50 |
| Silver iodobromide emulsion (Av. grain size: 0.27 μm, Av. iodide content: 2.0 mol %) | 0.21 |
| Sensitizing dye (SD-1) | $2.8\times10^{-4}$ |
| Sensitizing dye (SD-2) | $1.9\times10^{-4}$ |
| Sensitizing dye (SD-3) | $1.9\times10^{-5}$ |
| Sensitizing dye (SD-4) | $1.0\times10^{-4}$ |
| Cyan coupler (C-1) | 0.48 |
| Cyan coupler (C-2) | 0.14 |
| Colored cyan coupler (CC-1) | 0.021 |

-continued

| | |
|---|---|
| DIR compound (D-1) | 0.020 |
| High boiling solvent (Oil-1) | 0.53 |
| Gelatin | 1.30 |
| 4th layer: Medium speed red-sensitive layer | |
| Silver iodobromide emulsion (Av. grain size: 0.52 μm, Av. iodide content: 8.0 mol %) | 0.62 |
| Silver iodobromide emulsion (Av. grain size: 0.38 μm, Av. iodide content: 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| 5th layer: High speed red-sensitive layer | |
| Silver iodobromide emulsion (Av. grain size: 1.0 μm, Av. iodide content: 8.0 mol %) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| 6th layer: Interlayer | |
| Compound (SC-1) | 0.09 |
| High boiling solvent (Oil-2) | 0.11 |
| Gelatin | 0.80 |
| 7th layer: Low speed green-sensitive layer | |
| Silver iodobromide emulsion (Av. grain size: 0.38 μm, Av. iodide content: 8.0 mol %) | 0.61 |
| Silver iodobromide emulsion (Av. grain size: 0.27 μm, Av. iodide content: 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-1) | 0.75 |
| Gelatin | 1.95 |
| 8th layer: Medium speed green-sensitive layer | |
| Silver iodobromide emulsion (Av. grain size: 0.59 μm, Av. iodide content: 8.0 mol %) | 0.87 |
| Sensitizing dye (SD-6) | $2.4 \times 10^{-4}$ |
| Sensitizing dye (SD-5) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-1) | 0.50 |
| Gelatin | 1.00 |
| 9th layer: High speed green-sensitive layer | |
| Silver iodobromide emulsion (Emulsion A) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.012 |

-continued

| | |
|---|---|
| Gelatin | 1.00 |
| 10th layer Yellow filter layer | |
| Yellow colloid silver | 0.08 |
| Antistain agent (SC-2) | 0.15 |
| Formalin scavenger (HS-1) | 0.20 |
| High boiling solvent (Oil-2) | 0.19 |
| Gelatin | 1.10 |
| 11th layer: Interlayer | |
| Formalin scavenger (HS-1) | 0.20 |
| Gelatin | 0.60 |
| 12th layer: Low speed blue-sensitive layer | 0.22 |
| Silver iodobromide emulsion (Av. grain size: 0.38 μm, Av. iodide content: 8.0 mol %) | 0.03 |
| Silver iodobromide emulsion (Av. grain size: 0.27 μm, Av. iodide content: 2.0 mol %) | |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| 13th layer: Medium speed blue-sensitive layer | |
| Silver iodobromide emulsion (Av. grain size: 0.59 μm, Av. iodide content: 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling solvent (Oil-2) | 0.046 |
| Gelatin | 0.47 |
| 14th layer: High speed blue-sensitive layer | |
| Silver iodobromide emulsion (Av. grain size: 1.0 μm, Av. iodide content: 8.0 mol %) | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.80 |
| 15th layer: First protective layer | |
| Silver iodobromide emulsion (Av. grain size: 0.08 μm, Av. iodide content: 1.0 mol %) | 0.40 |
| UV absorber (UV-1) | 0.065 |
| UV absorber (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| 16th layer: Second protective layer | |
| Alkali-soluble matting agent (Av.size 2 μm) | 0.15 |
| Polymethymethaacrylate (Av.size 3 μm) | 0.04 |
| Sliding agent (WAX-1) | 0.04 |
| Gelatin | 0.55 |

Further to the above composition, were added a coating aid (SU-1), thickner, hardener (H-1 and H-2), stabilizer (ST-antifoggants (AF-1) and (AF-2, a mixture of weight-average molecualr weights of 10,000 and 1,100,000) and antiseptic agent (DI-1). The addition amount of DI-1 was 9.4 $mg/m^2$.

Chemical formulas of compounds used in the above sample are shown below.

C-1
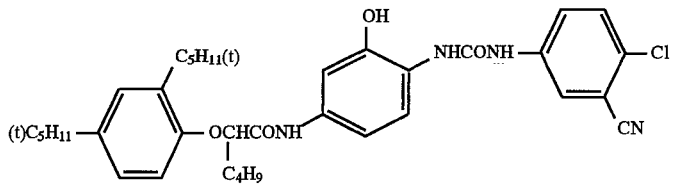
C-2
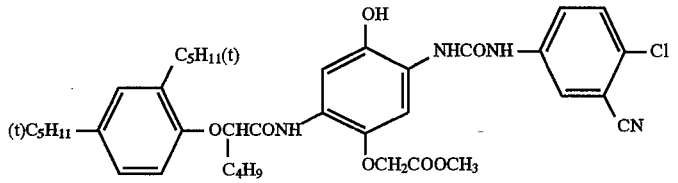
M-1
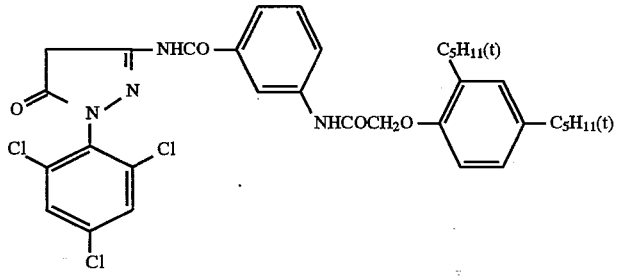
M-2
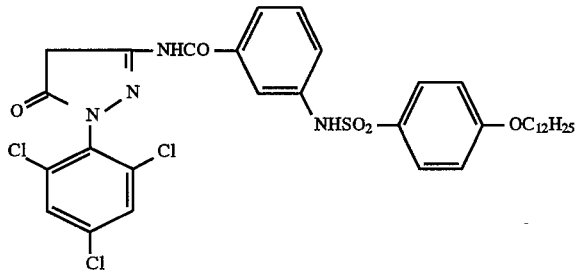
M-3
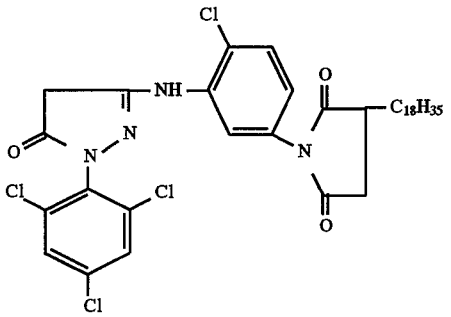
Y-1
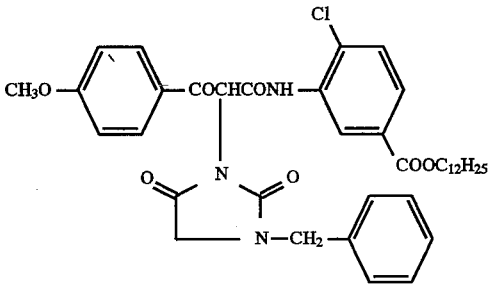
CC-1
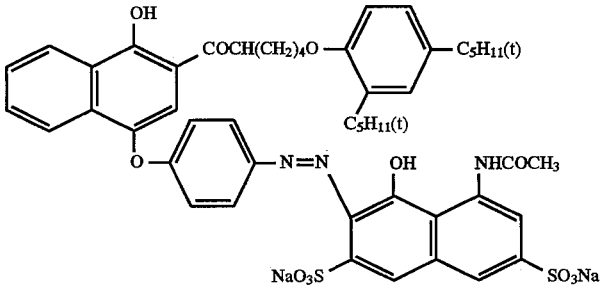

-continued
CM-1
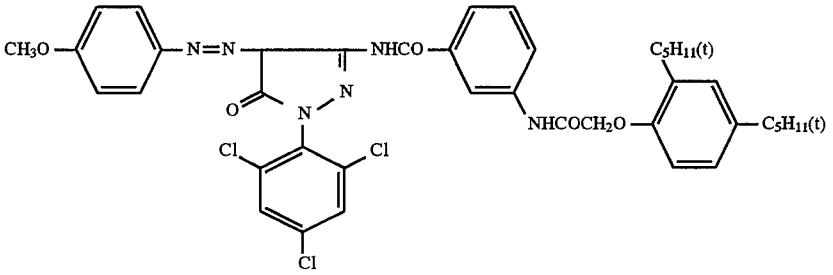
D-1
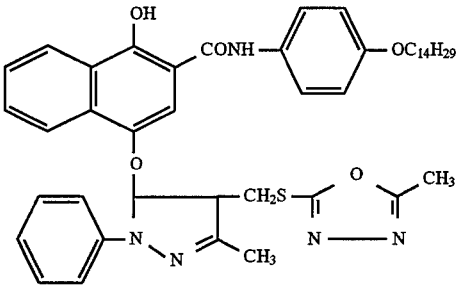
D-2
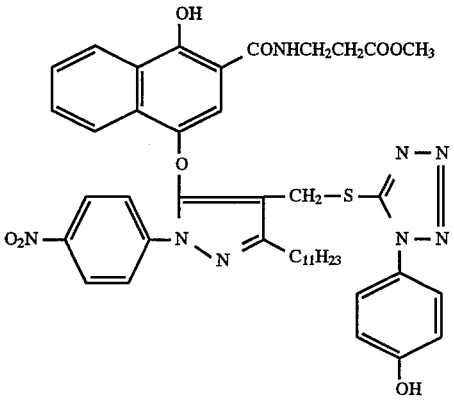
D-3
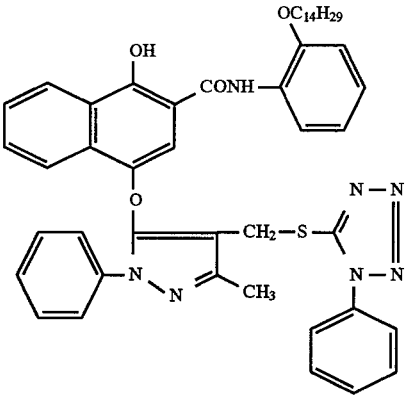
Oil-1
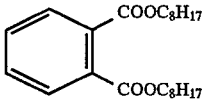
Oil-2
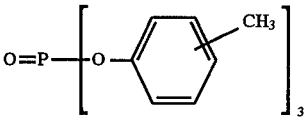
Oil-3
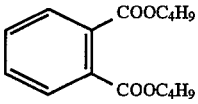

SC-1
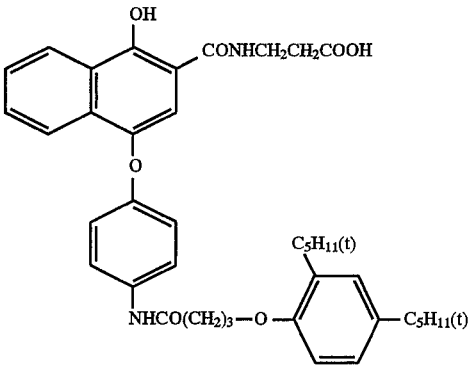
-continued
SC-2
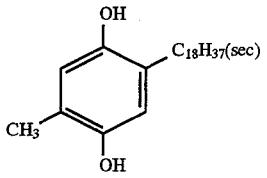
UV-1
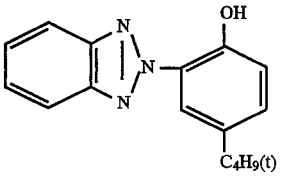
UV-2
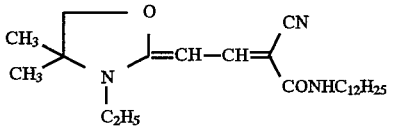
WAX-1
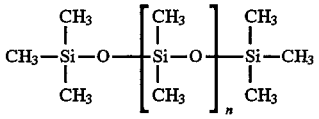
MW = 3,000 (weight-average molecular weight)
Su-1
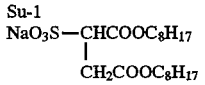
Su-2
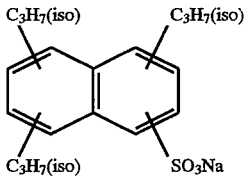
HS-1
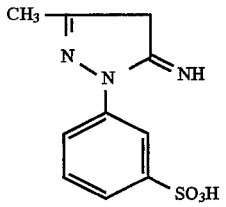
SD-1
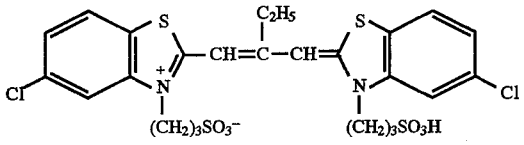
SD-2
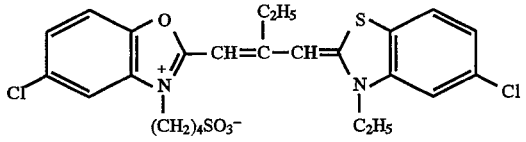
SD-3
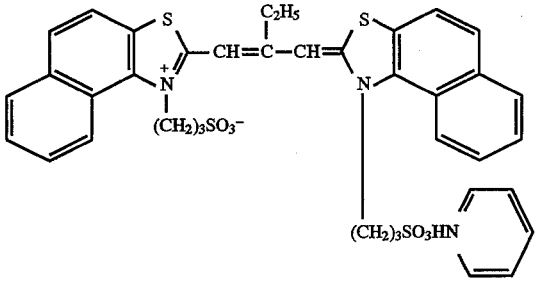
SD-4
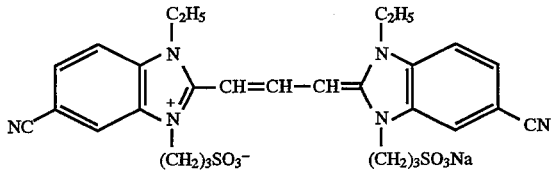
SD-5
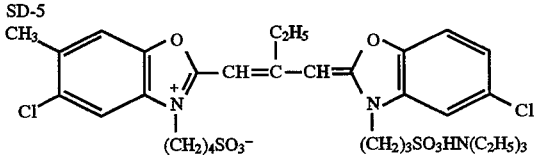

-continued
SD-6
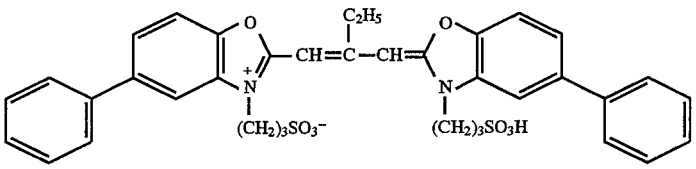
SD-7
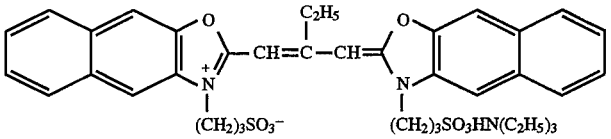
SD-8
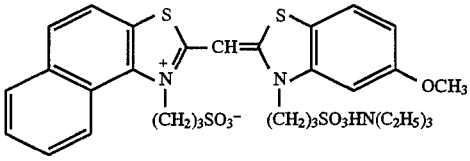
SD-9
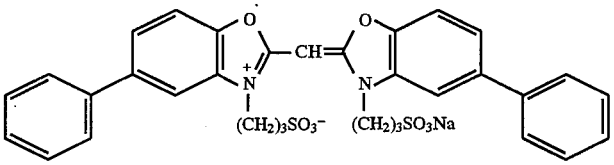
H-1
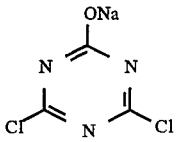
H-2
$(CH_2{=}CHSO_2CH_2)_2O$
AF-1
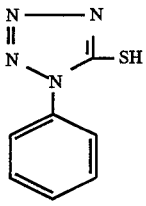
AF-2
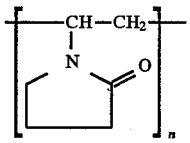
n: (polymerization degree)
DI-1
(A mixture of the following components)
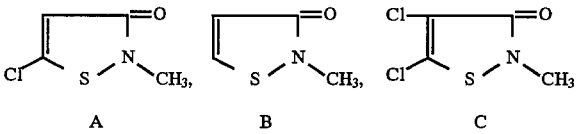
A B C
A:B:C = 50:46:4 (molar ratio)
ST-1
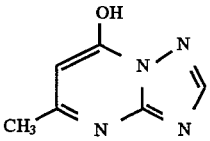

These samples were sensitometrically exposed to white light, followed by subjecting to aging under the condition of A or B. Thereafter, the samples were processed and evaluated with respect to sensitivity. Samples were also processed immediately after exposed to white light and evaluated.

| Aging conditions: | |
|---|---|
| A: 3 days at 40° C. and 20% R.H. | |
| B: 14 days at 23° C. and 50% R.H. | |
| Processing step (38° C.) | |
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

Compositions of processing solutions used in the above processing steps are as follows.

| Colo developer | |
|---|---|
| 4-Amino-3-methyl-N-ethyl-(β-hydroxyethyl)-anilin sulfate | 4.75 g |
| Anhyrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitriloacetate monohydrate | 2.5 g |
| Potassium hydroxide | 1.0 g |
| Water to make | 1 liter |
| The pH was adjusted to 10.0. | |
| Bleaching solution | |
| Ethylenediaminetetraacetic acid iron-ammonium salt | 100.0 g |
| Ethlenediaminetetraacetic acid ammonium salt | 10.0 g |
| Ammonium bromide | 150.0 g |
| Glacial acetic acid | 10.0 g |
| Water to make | 1 liter |

The pH was adjusted to 6.0 using aqueous ammonia solution.

| Fixing solution | |
|---|---|
| Ammonium thiosulfate | 175.0 g |
| Anhydrous sodium sulfite | 8.5 g |
| Sodium metasulfite | 2.3 g |
| Water to make | 1 liter |

The pH was adjusted to 6.0 using acetic acid.

| Stabilizer | |
|---|---|
| Formalin (37% aqueous solution) | 1.5 ml |
| Koniducks (Product of Konica Corp.) | 7.5 ml |
| Water to make | 1 liter |

Sensitivity (S) was shown as a relative value of a reciprocal of exposure amount nacessary to give a density of fog +0.1, based on the green sensitivity of sample No. 11 at immediately after exposure as being 100. Evaluation results with respect to the sensitivity and RMS granularity of samples Nos. 11 to 18 was shown in Table 3.

TABLE 3

| | | Sensitivity | | |
|---|---|---|---|---|
| Sample | Emulsion | Fresh | Aging-A | Aging-B |
| 11 | Em-1 (Comp.) | 100 | 84 | 79 |
| 12 | Em-2 (Comp.) | 106 | 103 | 101 |
| 13 | Em-3 (Comp.) | 110 | 86 | 84 |
| 14 | Em-4 (Comp.) | 106 | 95 | 93 |
| 15 | Em-5 (Inv.) | 115 | 112 | 109 |
| 16 | Em-6 (Inv.) | 110 | 108 | 107 |
| 17 | Em-7 (Comp.) | 102 | 93 | 98 |
| 18 | Em-8 (Inv.) | 112 | 106 | 109 |

As can be seen from Table 3, samples Nos. 15, 16 and 18 by use of the inventive emulsions Em-5, Em-6 and Em-8 exhibited higher sensitivity at immediately after exposure, as compared to comparative samples. In addition thereto, with respect to sensitivities after being aged under conditions A and B, inventive samples were also higher in sensitivity, as compared to comparative samples. Thus, the inventive emulsions were shown to be high in sensitivity and excellent in storage stability.

Example 2

Preparation of twinned crystal seed grain emulsion (t-1)

A seed emulsion comprising grains having two parallel twin planes was prepared according to the following procedure.

| Solution A | |
|---|---|
| Ossein gelatin | 80.0 g |
| Potassium bromide | 47.4 g |
| 10% Methanol solution of $HO(CH_2CH_2O)_m$—$[CH(CH_3)CH_2O]_{19.8}(CH_2CH_2O)_nH$ ($m \pm n = 9.77$) | 0.48 ml |
| Water to make | 8000.0 ml |
| Solution B | |
| Silver nitrate | 1200.0 g |
| Water to make | 1600.0 ml |
| Solution C | |
| Ossein gelatin | 32.3 g |
| Potassium bromide | 790.0 g |
| Potassium iodide | 70.34 g |
| Water to make | 1600.0 ml |
| Solution D | |
| Aqueous ammonia solution (28%) | 470.0 ml |

To Solution A with vigorously-stirring, Solutions B and C were added by double jet technique for 7.7 min. to form nuclei, while being kept at pBr of 1.60.

Thereafter, the temperature was lowered to 20° C. taking 30 min. Then, Solution D was added thereto for one min. and the emulsion was ripened for 5 min., wherein the concentrations of KBr and ammonia were 0.03 mol/l and 0.66 mol/l, respectively. After completing ripening, the pH was adjusted to 6.0 and then desalting was carried out in a conventional manner.

To the emulsion desalted was added 1884 ml of aqueous 10 wt. % gelatin solution and after carrying out stirring-dispersion, 130 ml of aqueous solution containing 21 g of silver nitrate was added to the emulsion, which was further ripened for 80 min. with pAg controlled at 1.9 at 60° C. Thereafter, 193 ml of an aqueous solution containing 14.5 g of potassium bromide was added to the emulsion, the temperature thereof was lowered to 40° C. and distilled water was added thereto to make 5360 g.

According to electron microscopic observation, it was revealed that the seed emulsion comprised spherical grains each having two parallel twin planes. The seed grains have an average size of 0.217 μm, 75% by number of the total grains being accounted for by the grains having two parallel twin planes.

Preparation of a twinned crystal seed grain emulsion (t-2)

The seed emulsion (t-2) was prepared in the same manner as the seed emulsion (t-1), provided that, after desalting, an aqueous 10% gelatin solution was added to the emulsion, which was dispersed for 30 min. at 60° C. and distilled water was added threrto to make 5360 g.

Preparatio of a twinned crystal seed grain emulsion (t-3)

The seed emulsion (t-3) was prepared in the same manner as the seed emulsion (t-1), provided that, after desalting, 1884 ml of an aqueous 10% gelatin solution was added to the emulsion, which was dispersed for 15 min. at 60° C. and 130 ml of an aqueous solution containing 39 g of silver nitrate was added threrto and ripening was carried out further for 80 min. with controlled pAg at 1.5 at 60° C. Thereafter, 193 ml of an aqueous solution containing 27.1 g of potassium bromide was added to the emulsion, the temperature thereof was lowered to 40° C. and distilled water was added thereto to make a total weight of 5360 g.

Preparation of comparative emulsion (Em-21)

Comparative emulsion (Em-21) was prepared using the following seven kinds of solutions.

| Solution H | |
|---|---|
| Ossein gelatin | 61.0 g |
| Distilled water | 1963.0 ml |
| 10% Methanol solution of $HO(CH_2CH_2O)_m$—$[CH(CH_3)CH_2O]_{19.8}(CH_2CH_2O)_nH$ ($m \pm n = 9.77$) | 2.50 ml |
| Seed grain emulsion (t-2) | 0.345 mol |
| Aq. 28 wt. % ammonia solution | 308.0 ml |
| Aq. 56 wt % acetic acid solution | 358.0 ml |
| Distilled water | 2000 ml |

Solution I

Aq. 3.5N ammoniacal silver nitrate solution (pH was adjusted to 9.0 with ammonium nitrate.)

Solution J

Aq. 3.5N potassium bromide solution

Solution K

Fine grain emulsion comprising silver iodide grains (av. size of 0.05 Bm) and 3 wt % gelatin The fine grain emulsion was prepared as follows. To 5000 ml of a 6.0 wt. % gelatin solution containing 0.06 mol of possium iodide, were added an aqueous solution containing 7.06 mol of silver nitrate and aqueous solution containing 7.06 mol of potassium iodide (2000 ml of each) for 10 min., while being maitained at a pH of 2.0 and a temperature of 40° C. After completion of the grain formation, the pH was adusted to 6.0 using aqueous solution of sodium carbonate.

Solution L

Fine grain emulsion comprising silver iodobromide grains containing 2 mol % iodide (av. size 0.04 μm) prepared in a similar manner to Solution K as above described, provided, the temperature was maintained at 30° C. during the course of grain formation.

Solution M

Aq. 1.75N potassium bromide solution

Solution N

Aq. 56 wt. % acetic acid solution

To Solution H with vigorously-stirring at 70° C. was instantaneously added 33.7 ml of methanol solution containing 450 mg of iodine ($1\times10^{-4}$ mol/mol Ag), then Solutions I, J and K were simultaneously added thereto for 188 min. and further Solution L was added at a constant rate for 7 min. to cause the seed grains to grow to 0.806 μm.

Addition rates of Solutions I and J were each accelerated varied, while being in balance with a critical growth rate so as not to cause production of nucleus grains and polydispersion of growing grains due to Ostwald ripenining. Addition of Solution K (silver iodide fine grain emulsion), which was expressed as a ratio of addion rate thereof to that of an ammoniacal silver nitrate solution in mol. was varied with time, as shown in Table 4.

Using Solutions M and N, the pAg and pH were each controlled, as shown in Table 4. The measurement thereof was carried out using a silver sulfide electrode or glass electrode in a conventional manner.

After completion of grain formation, the emulsion was desalted in accordance with a method described in JP-A 5-72658/1993 and after adding gelatin for dispersion, the pH and pAg thereof were adjusted respectively to 5.80 and 8.06. Based on the scanning-type electronmicroscopic observation of the resulting emulsion grains, it was revealed that the emulsion was comprised of monodispersed, octahedral, twinned crystal grains having an average size of 0.806 μm and a distribution width of 13.0%.

TABLE 4

| Time | Grain size (μM) | Addition rate ratio of Soln. K | pH | pAg |
|---|---|---|---|---|
| 0.0 | 0.217 | 6.0 | 7.2 | 7.8 |
| 26.20 | 0.345 | 20.1 | 7.2 | 7.8 |
| 40.86 | 0.394 | 29.5 | 7.2 | 7.8 |
| 41.57 | 0.397 | 30.0 | 7.2 | 7.8 |
| 54.11 | 0.434 | 30.0 | 7.2 | 7.8 |
| 64.89 | 0.466 | 30.0 | 7.2 | 7.8 |
| 68.00 | 0.480 | 27.9 | 7.2 | 7.8 |
| 78.00 | 0.500 | 24.9 | 7.2 | 7.8 |
| 88.00 | 0.520 | 21.9 | 7.2 | 7.8 |
| 98.00 | 0.540 | 18.9 | 7.2 | 7.8 |
| 108.00 | 0.560 | 15.9 | 7.2 | 7.8 |
| 118.00 | 0.580 | 12.9 | 7.2 | 7.8 |
| 128.00 | 0.600 | 9.9 | 7.2 | 7.8 |
| 138.00 | 0.620 | 6.9 | 7.2 | 7.8 |
| 138.00 | 0.620 | 6.9 | 6.5 | 9.7 |
| 148.00 | 0.640 | 3.9 | 6.5 | 9.7 |
| 158.00 | 0.666 | 0.0 | 6.5 | 9.7 |
| 188.00 | 0.745 | 0.0 | 6.5 | 9.7 |

Preparation of comparative emulsion (Em-22)

An comparative emulsion (Em-22) was prepared in the same manner as the emulsion (Em-21), provided that the following solution (Q-1) was added pivot to the addition of Solutions I, J and K.

Solution Q-1

Aq. nitric acid solution (0.1% by volume) containing $InCl_3 4H_2O$ of $5\times10^{-5}$ mol per mol Ag Preparation of comparative emulsion (Em-23)

An comparative emulsion (Em-23) was prepared in the same manner as the emulsion (Em-21), provided that a seed emulsion was replaced by seed emulsion t-1.

Preparation of comparative emulsion (Em-24)

An comparative emulsion (Em-24) was prepared in the same manner as the emulsion (Em-21), provided that a seed emulsion was replaced by seed emulsion t-3.

Preparation of comparative emulsion (Em-25)

An comparative emulsion (Em-25) was prepared in the same manner as the emulsion (Em-23), provided that Solution Q-1 was added pivot to the addition of Solutions I, J and K.

Preparation of comparative emulsion (Em-26)

An comparative emulsion (Em-26) was prepared in the same manner as the emulsion (Em-24), provided that Solution Q-1 was added prior to the addition of Solutions I, J and K.

Silver halide color photographic material samples 21 through 26 were prepared in the same manner as in Example 1, provided that as Emulsion A used in the 9th layer was used emulsion Em-5 and in the 14th layer was used emulsions Em-21 to Em-26, respectively, which was optimally chemical-sensitized.

These samples were subjected to exposure and processing and evaluated with respect to sensitivity and latent image stability in the same manner as in Example 1. Results thereof are shown in Table 5.

TABLE 5

| Sample | Emulsion (14th-layer) | Sensitivity Fresh | Aging-A | Aging-B | Reduction sensitization | Metal ion |
|---|---|---|---|---|---|---|
| 21 | Em-21 (Comp.) | 100 | 78 | 73 | No | No |
| 22 | Em-22 (Comp.) | 109 | 82 | 75 | No | $In^{3+}$ |
| 23 | Em-23 (Comp.) | 107 | 103 | 100 | Yes | No |
| 24 | Em-24 (Comp.) | 103 | 100 | 97 | Yes | No |
| 25 | Em-25 (Inv.) | 115 | 110 | 109 | Yes | $In^{3+}$ |
| 26 | Em-26 (Inv.) | 111 | 108 | 104 | Yes | $In^{3+}$ |

The sensitivity was shown as a relative value of a reciprocal of an exposure amount nacessary to give a density of fog +0.1, based on the blue sensitivity of sample No. 21 at immediately after exposure as being 100.

As can be seen from Table 5, samples 25 and 26 prepared by using inventive emulsions Em-25 and Em-26 were each high in sensitivity and excellent in storage stability of latent image.

Emulsions Em-27 and Em-28 were optimally chemical-sensitized and silver halide color photographic material samples 27 and 28 were prepared in the same manner as in Example 2, provided that these emulsion Em-27 and 28 were each used in the 14th layer.

These samples were subjected to exposure and procesing and evaluated in a manner similar to Example 1, provided that the samples were exposed in a time of $10^{-6}$, $10^{-2}$ or 1 sec. and evaluated with respect to characteristics of reciprocity law failure. Results thereof are shown in Table 6.

The sensitivity represents a relative value of reciprocal of an exposure amount necessary to give a density of fog +0.1 based on the blue sensitivity of sample No. 21 at immediately after exposure as being 100.

TABLE 6

| Sample | Emulsion (14th-layer) | Sensitivity* $10^{-6}$ sec. | $10^{-2}$ sec. | 1 sec. | Sensitivity** $10^{-6}$ sec. | $10^{-2}$ sec. | 1 sec. | Reduction sensitization | Ir |
|---|---|---|---|---|---|---|---|---|---|
| 21 | 21 (Comp.) | 91 | 100 | 98 | 60 | 78 | 85 | No | No |
| 23 | 23 (Comp.) | 96 | 107 | 110 | 89 | 103 | 106 | Yes | No |
| 27 | 27 (Comp.) | 93 | 93 | 97 | 61 | 67 | 73 | No | Yes |
| 28 | 28 (Inv.) | 103 | 102 | 104 | 99 | 99 | 101 | Yes | Yes |

*Sensitivity immediately after exposure

**Sensitivity after being aged under condition A

Example 3

Preparation of comparative emulsion (Em-27)

A comparatove emulsion (Em-27) was prepared in the same manner as comparative emulsion (Em-22), provided that, in place of Solution Q-1, was added the following solution (Q-2) at a time of 160 min. after starting the addition of Solutions I, j and K.

Solution Q-2

Aq. 25% NaCl solution containing $K_2IrCl_6$ of $1\times10^{-8}$ mol per mol of silver halide.

Preparation of comparative emulsion (Em-28)

A comparative emulsion (Em-28) was prepared in the same manner as comparative emulsion (Em-23), provided that, in place of Solution Q-1, was added Solution Q-2 at a time of 160 min. after the start of the addition of Solutions I, J and K.

From Table 6, it is shown that the inventive emulsion is improved in reciprocity law failure and latent image stability.

What is claimed is:

1. A silver halide photographic emulsion comprising silver halide grains containing a metal ion and reduction sensitization nucleus in an internal portion of the grains, said grains having an average iodide content ($I_2$) of 2 to 30 mol % and satisfying the following requirement, $$I_1<I_2$$

wherein $I_1$ represents an average iodide content of an outermost surface layer of the grains; and said metal ion is selected from the group consisting of $In^{3+}$ and $Pb^{2+}$.

2. The silver halide emulsion of claim 1, wherein said metal ion is $Pb^{2+}$.

3. The silver halide emulsion of claim 1, wherein said metal ion is $In^{3+}$.

4. The silver halide emulsion of claim 1, wherein said outermost surface layer has a thickness of from the surface to a depth as reached by X-ray in X-ray photoelectron spectroscopy.

5. The silver halide emulsion of claim 4, wherein said outermost surface layer has a thickness of 50A from the grain surface.

6. The silver halide emulsion of claim 1, wherein the iodide content of the outermost surface layer is 0 to 15 mol % iodide.

7. The silver halide emulsion of claim 1, wherein said grains are twinned crystal grains.

8. The silver halide emulsion of claim 7, wherein said grains are tabular grains having an aspect ratio of diameter to thickness of 1.3 to 5.0 and accounting for 60% or more of projected area of total grains.

9. The silver halide emulsion of claim 8, wherein said grains are silver iodobromide or silver iodochloride; and said outermost layer has a thickness of 50 Å from the grain surface.

10. The silver halide emulsion of claim 1, wherein said grains are silver iodobromide or silver iodochlorobromide.

11. A method of preparing a silver halide emulsion comprising the steps of:

(i) forming silver halide grains by adding into a reaction vessel a water-soluble silver salt and water-soluble halide salt, or silver halide fine grains to form an emulsion and (ii) subjecting the emulsion formed to desalting to remove soluble salts, wherein, in the step of (i), a metal ion is introduced and the emulsion is reduction-sensitized by ripening the emulsion in the presence of a reducing agent or at a pH of 7.0 or more or pAg of 7.0 or less before 97% of the ultimate grain volume of said silver halide grains is reached, said silver halide grains having an average iodide content ($I_2$) of 2 to 30 mol % and satisfying the following requirement, $$I_1 < I_2$$

wherein $I_1$ represents an average iodide content of an outermost surface layer of the grains; and said metal ion is selected from the group consisting of $Pb^{2+}$ and $In^{3+}$.

12. The method of claim 11, wherein the emulsion is reduction-sensitized by ripening in the presence of thiourea dioxide.

13. The method of claim 11, wherein the emulsion is reduction-sensitized by ripening the emulsion at a pH of 7.0 or more before 97% of the the ultimate grain volume of said silver halide grains is reached.

14. The method of claim 11, wherein, in the step of (i), silver halide seed grains preformed are introduced in the reaction vessel and subsequenly said silver halide grains are formed by causing the seed grains to grow with the addition of the water-soluble silver salt and halide salt, or the fine grains.

15. The method of claim 14, wherein said seed grains are previously reduction-sensitized by ripenining at a pH of not less than 7.0 or a pH of 7.0 or more before being introduced to the reaction vessel.

16. The method of claim 11, wherein said metal ion is $Pb^{2+}$.

17. The method of claim 11, wherein said metal ion is $In^{3+}$.

* * * * *